US011982037B2

(12) United States Patent
Zhao et al.

(10) Patent No.: US 11,982,037 B2
(45) Date of Patent: May 14, 2024

(54) MICROBUBBLE TREATMENT AGENT CARTRIDGE ASSEMBLY AND WASHING EQUIPMENT HAVING SAME

(71) Applicants: QINGDAO HAIER WASHING MACHINE CO., LTD., Shandong (CN); Haier Smart Home Co., Ltd., Shandong (CN)

(72) Inventors: Zhiqiang Zhao, Qingdao (CN); Sheng Xu, Qingdao (CN)

(73) Assignees: QINGDAO HAIER WASHING MACHINE CO., LTD., Qingdao (CN); Haier Smart Home Co., Ltd., Qingdao (CN)

( * ) Notice: Subject to any disclaimer, the term of this patent is extended or adjusted under 35 U.S.C. 154(b) by 247 days.

(21) Appl. No.: 17/777,903

(22) PCT Filed: Nov. 20, 2020

(86) PCT No.: PCT/CN2020/130535
§ 371 (c)(1),
(2) Date: May 18, 2022

(87) PCT Pub. No.: WO2021/098838
PCT Pub. Date: May 27, 2021

(65) Prior Publication Data

US 2022/0411985 A1 Dec. 29, 2022

(30) Foreign Application Priority Data

Nov. 22, 2019 (CN) ..... 201911159164.8
Nov. 26, 2019 (CN) ..... 201911177019.2

(51) Int. Cl.
*D06F 35/00* (2006.01)
*D06F 39/02* (2006.01)
*D06F 39/08* (2006.01)

(52) U.S. Cl.
CPC ..... *D06F 35/002* (2013.01); *D06F 39/02* (2013.01); *D06F 39/088* (2013.01)

(58) Field of Classification Search
CPC ..... D06F 35/002
See application file for complete search history.

(56) References Cited

U.S. PATENT DOCUMENTS 4,210,534 A 7/1980 Molver
2018/0274154 A1 9/2018 Park et al.

FOREIGN PATENT DOCUMENTS

CN 2080515 U 7/1991
CN 201729714 U 2/2011
(Continued)

OTHER PUBLICATIONS

International Search Report dated Feb. 22, 2021, in corresponding to International Application No. PCT/CN2020/130535; 8 pages (with English Translation).

*Primary Examiner* — Jason Y Ko
(74) *Attorney, Agent, or Firm* — Maier & Maier, PLLC

(57) ABSTRACT

A microbubble treatment agent cartridge assembly and washing equipment having the microbubble treatment agent cartridge assembly. The microbubble treatment agent cartridge assembly includes a housing and a treatment agent cartridge accommodated in the housing. The housing is provided with at least one water inlet pipe portion. The at least one water inlet pipe portion is provided internally with at least one stage of diameter-decreasing tapered portion and a microbubble former, and the pipe wall thereof is further provided with an air inlet hole. The air inlet hole is positioned between the at least one stage of diameter-decreasing tapered portion and the microbubble former, and communicates with an air inlet pipe disposed on the housing. The top of the most downstream stage of diameter-decreasing tapered portion is provided with a spray hole. The spray hole
(Continued)

enables the water flow flowing through the at least one stage of diameter-decreasing tapered portion.

10 Claims, 5 Drawing Sheets

(56) References Cited

FOREIGN PATENT DOCUMENTS

| | | | |
|---|---|---|---|
| CN | 206152654 | U | 5/2017 |
| CN | 108602030 | A | 9/2018 |
| CN | 208512297 | U | 2/2019 |
| JP | 2014-168759 | A | 9/2014 |
| JP | 2018-176145 | A | 11/2018 |
| JP | 2019-187686 | A | 10/2019 |

A-A sectional view

A-A sectional view

MICROBUBBLE TREATMENT AGENT CARTRIDGE ASSEMBLY AND WASHING EQUIPMENT HAVING SAME

CROSS-REFERENCE TO RELATED APPLICATIONS

The present application claims priority from the following prior applications:

Chinese patent application for invention with the application No. "201911159164.8" filed on Nov. 22, 2019; and Chinese patent application for invention with the application No. "201911177019.2" filed on Nov. 26, 2019. The contents of these applications are incorporated into the present application by reference in their entirety.

FIELD

The present disclosure relates to a washing apparatus, and specifically relate to a micro-bubble treatment agent box assembly and a washing apparatus having the micro-bubble treatment agent box assembly.

BACKGROUND

Micro-bubbles usually refer to tiny bubbles with a diameter below 50 micrometers (μm) during bubbles generation. Micro-bubbles may also be called micro-/nano-bubbles, micron-bubbles or nano-bubbles depending on their ranges of diameter. Due to their low buoyancy in a liquid, micro-bubbles stay for a longer time in the liquid. Furthermore, the micro-bubbles will shrink in the liquid until they finally break up, generating smaller nano-bubbles. In this process, a rising speed of the bubbles becomes slow since the bubbles become smaller, thus resulting in a high melting efficiency. When the micro-bubbles break up, high-pressure and high-temperature heat is locally generated, thereby destroying foreign objects such as organic matters floating in the liquid or adhering to objects. In addition, the shrinkage process of micro-bubbles is also accompanied by an increase in negative charges. A peak state of negative charges usually occurs when the diameter of the micro-bubbles is 1-30 microns, so it is easy for them to adsorb positively charged foreign matters floating in the liquid. The result is that the foreign matters are adsorbed by the micro-bubbles after they are destroyed due to the breaking up of the micro-bubbles, and then slowly float to a surface of the liquid. These properties enable the micro-bubbles to have extremely strong cleaning and purifying abilities. At present, micro-bubbles have been widely used in washing apparatuses such as clothing washing machines.

For example, Chinese patent publication No. CN108602030A discloses a washing machine with a water injection device. The water injection device includes an electromagnetic water supply valve, a water injection box, and a micro-bubble generator arranged between the electromagnetic water supply valve and the water injection box. The micro-bubble generator has a cylindrical shape with a flange, and includes a flow path member and a collision part provided in the flow path member. The collision part locally reduces a cross-sectional area of flow path in the flow path member so that micro-bubbles are generated in the liquid passing through the flow path. After the electromagnetic water supply valve is opened, a water flow from a main water pipe is rapidly depressurized when it flows through this micro-bubble generator, so that air in the water flow is separated out to generate micro-bubbles in the water; then the micro-bubble water flows into the water injection box and mixes with a detergent or softener and the like in the water injection box before entering a washing drum for washing clothing. However, this micro-bubble generator can only rely on the very limited air carried inside the liquid flowing through the micro-bubble generator to generate micro-bubbles; therefore, this micro-bubble generator cannot provide the water injection box with micro-bubble water having enough micro-bubbles, thus affecting the dissolution of the detergent or softener.

Accordingly, there is a need in the art for a new technical solution to solve the above problem.

SUMMARY

In a first embodiment, in order to solve the above problem in the prior art, that is, to solve the technical problem that a generation rate of micro-bubbles in the existing water injection box is not high, the present disclosure provides a micro-bubble treatment agent box assembly. The micro-bubble treatment agent box assembly includes a housing and a treatment agent box accommodated in the housing; at least one water inflow pipe part is provided on the housing, and at least one of the at least one water inflow pipe part is provided therein with an at-least-one-stage diameter-decreased conical part and a micro-bubble bubbler; a pipe wall of the at least one of the at least one water inflow pipe part is also provided with an air inflow hole; the air inflow hole is positioned between the at-least-one-stage diameter-decreased conical part and the micro-bubble bubbler and communicates with an air inflow pipe provided on the housing; a spray hole is provided at a top end of a most-downstream-stage diameter-decreased conical part; the spray hole is arranged such that a water flow flowing through the at-least-one-stage diameter-decreased conical part can be expanded and sprayed through the spray hole and generate a negative pressure near the air inflow hole, so that air can be sucked into the water inflow pipe part from the air inflow pipe and mix with the water flow to generate bubble water; and the bubble water flows through the micro-bubble bubbler to become micro-bubble water, which is then sprayed into the treatment agent box.

In a preferred technical solution of the above micro-bubble treatment agent box assembly, a flow disturbing part is provided on an inner wall of the at-least-one-stage diameter-decreased conical part.

In a preferred technical solution of the above micro-bubble treatment agent box assembly, the flow disturbing part is at least one radial protrusion arranged on the inner wall of the at-least-one-stage diameter-decreased conical part or at least one flow disturbing rib extending longitudinally along the inner wall of the at-least-one-stage diameter-decreased conical part.

In a preferred technical solution of the above micro-bubble treatment agent box assembly, the flow disturbing part is positioned on an inner wall of the most-downstream-stage diameter-decreased conical part.

In a preferred technical solution of the above micro-bubble treatment agent box assembly, the at-least-one-stage diameter-decreased conical part includes two or more stages of diameter-decreased conical parts.

In a preferred technical solution of the above micro-bubble treatment agent box assembly, at least one spray cavity is also provided in the housing, and the at least one spray cavity is arranged between the at least one water inflow pipe part and the treatment agent box so that the micro-bubble water is sprayed into the treatment agent box through the at least one spray cavity.

In a preferred technical solution of the above micro-bubble treatment agent box assembly, the at least one water inflow pipe part includes a main water inflow pipe part and an auxiliary water inflow pipe part, and the treatment agent box includes a detergent chamber and at least one care agent chamber, in which the main water inflow pipe part is configured to provide micro-bubble water for the detergent chamber, and the auxiliary water inflow pipe part is configured to provide micro-bubble water for the at least one care agent chamber.

In a preferred technical solution of the above micro-bubble treatment agent box assembly, the micro-bubble bubbler is a hole mesh structure, and the hole mesh structure has at least one fine hole having a diameter reaching a micron scale.

In a preferred technical solution of the above micro-bubble treatment agent box assembly, the hole mesh structure includes plastic fence, metal mesh, or macromolecular material mesh.

It can be understood by those skilled in the art that in the technical solutions of the present disclosure, the micro-bubble treatment agent box assembly includes a housing and a treatment agent box accommodated in the housing. At least one water inflow pipe part is provided on the housing, and at least one of the at least one water inflow pipe part is provided therein with an at-least-one-stage diameter-decreased conical part and a micro-bubble bubbler. The water flow can be accelerated when flowing in the at-least-one-stage diameter-decreased conical part. A spray hole is provided at a top end of a most downstream stage of the at-least-one-stage diameter-decreased conical part. The water flow can be expanded and sprayed through the spray hole and generate a negative pressure downstream of the at-least-one-stage diameter-decreased conical part. A pipe wall of the at least one of the at least one water inflow pipe part is also provided with an air inflow hole, and the air inflow hole is located between the at-least-one-stage diameter-decreased conical part and the micro-bubble bubbler and communicates with an air inflow pipe provided on the housing, so that a large amount of outside air can be sucked in through the air inflow pipe under the action of negative pressure, and the large amount of air can mix with the water flow to generate a large number of bubbles in the water. The bubble water carrying a large number of bubbles is then cut and mixed as it flows through the micro-bubble bubbler to produce micro-bubble water containing a large number of micro-bubbles. The micro-bubble water is then sprayed into the treatment agent box to dissolve and mix with the treatment agent in the treatment agent box. Therefore, through a joint action of the at-least-one-stage diameter-decreased conical part, the spray hole, and the air inflow pipe communicating with the air inflow hole, the micro-bubble treatment agent box assembly of the present disclosure significantly improves the efficiency of micro-bubble generation, thereby further promoting rapid dissolution and mixing of the treatment agent in the water more effectively; moreover, the amount of the treatment agent used can be saved, which is also advantageous for the health of users.

Preferably, the flow disturbing part provided on the inner wall of the at-least-one-stage diameter-decreased conical part can help the water flow mix with the sucked air more effectively at a downstream position by increasing the turbulence of water. The flow disturbing part may be, for example, at least one radial protrusion arranged on the inner wall of the at-least-one-stage diameter-decreased conical part or at least one flow disturbing rib extending longitudinally along the inner wall of the at-least-one-stage diameter-decreased conical part.

Preferably, providing more stages of diameter-decreased conical part helps further increase the speed of the water flow.

Preferably, the spray cavity provided between the water inflow pipe part and the treatment agent box can help spray the micro-bubble water into the treatment agent box evenly.

In a second embodiment, in order to solve the above problem in the prior art, that is, to solve the technical problem that a generation rate of micro-bubbles in the existing water injection box is not high, the present disclosure provides a micro-bubble treatment agent box assembly. The micro-bubble treatment agent box assembly includes a housing and a treatment agent box accommodated in the housing; the housing is provided with at least one water inflow pipe part, and at least one spray cavity positioned above the treatment agent box; an at-least-one-stage diameter-decreased conical passage part is provided between at least one of the at least one water inflow pipe part and at least one of the at least one spray cavity in a water flow direction; a spray hole is provided at a downstream end of the at-least-one-stage diameter-decreased conical passage part; an air inflow passage is also provided on the housing, and an outlet of the air inflow passage is positioned close to the spray hole, so that water flow is expanded and sprayed from the spray hole to generate a negative pressure near the outlet, which sucks in outside air through the air inflow passage so that the outside air mixes with the water flow to form bubble water; and the at least one of the at least one spray cavity is provided therein with a micro-bubble bubbler, so that the bubble water becomes micro-bubble water under the action of the micro-bubble bubbler, which is then sprayed into the treatment agent box.

In a preferred technical solution of the above micro-bubble treatment agent box assembly, a flow disturbing part is provided on an inner wall of the at-least-one-stage diameter-decreased conical passage part.

In a preferred technical solution of the above micro-bubble treatment agent box assembly, the flow disturbing part is at least one radial protrusion arranged on the inner wall of the at-least-one-stage diameter-decreased conical passage part or at least one flow disturbing rib extending longitudinally along the inner wall of the at-least-one-stage diameter-decreased conical passage part.

In a preferred technical solution of the above micro-bubble treatment agent box assembly, the flow disturbing part is positioned on an inner wall of the most-downstream-stage diameter-decreased conical passage part.

In a preferred technical solution of the above micro-bubble treatment agent box assembly, the at-least-one-stage diameter-decreased conical passage part includes two or more stages of diameter-decreased conical passage parts.

In a preferred technical solution of the above micro-bubble treatment agent box assembly, a connection part surrounding the at least one spray cavity is formed between the at least one water inflow pipe part and the at least one spray cavity, and the air inflow passage is formed on the connection part.

In a preferred technical solution of the above micro-bubble treatment agent box assembly, the at least one water inflow pipe part includes a main water inflow pipe part and an auxiliary water inflow pipe part, the at least one spray cavity includes a first spray cavity and a second spray cavity, and a one-stage diameter-decreased conical passage part is provided between the water inflow pipe part and the first spray cavity, as well as between the auxiliary water inflow pipe part and the second spray cavity, respectively.

In a preferred technical solution of the above micro-bubble treatment agent box assembly, the micro-bubble bubbler is a hole mesh structure, and the hole mesh structure has at least one fine hole having a diameter reaching a micron scale.

In a preferred technical solution of the above micro-bubble treatment agent box assembly, the hole mesh structure includes plastic fence, metal mesh, or macromolecular material mesh.

It can be understood by those skilled in the art that in the technical solutions of the present disclosure, the micro-bubble treatment agent box assembly includes a housing and a treatment agent box accommodated in the housing. The housing is provided with at least one water inflow pipe part, and at least one spray cavity positioned above the treatment agent box, and an at-least-one-stage diameter-decreased conical passage part is provided between at least one of the at least one water inflow pipe part and at least one of the at least one spray cavity in a water flow direction. Therefore, a water flow from the water inflow pipe part can first flow through the at-least-one-stage diameter-decreased conical passage part and be pressurized therein before entering the spray cavity. A spray hole is provided at a downstream end of the at-least-one-stage diameter-decreased conical passage part, and the pressurized water flow is sprayed from the spray hole and is rapidly expanded due to a sudden increase of the downstream flow cross-section, thus causing a negative pressure near a position downstream of the spray hole. The housing is also provided with an air inflow passage, and an outlet of the air inflow passage is positioned close to the spray hole, so that outside air is sucked in through the air inflow passage under the action of negative pressure and mixes with the water flow to form bubble water. A micro-bubble bubbler is arranged in the at least one spray cavity, so that the bubble water becomes micro-bubble water in the spray cavity under the action of the micro-bubble bubbler, and then is sprayed into the treatment agent box, so that the micro-bubble water is used to dissolve and mix with one or more treatment agents in the treatment agent box. Therefore, through a joint action of the at-least-one-stage diameter-decreased conical passage part arranged between the water inflow pipe part and the treatment agent box, the spray hole, the air inflow passage, and the micro-bubble bubbler, the micro-bubble treatment agent box assembly of the present disclosure significantly improves the efficiency of micro-bubble generation, thereby further promoting rapid dissolution and mixing of the treatment agent in the water more effectively; moreover, the amount of the treatment agent used can be saved, which is also advantageous for the health of users.

Preferably, the flow disturbing part provided on the inner wall of the at-least-one-stage diameter-decreased conical passage part can help the water flow mix with the sucked air more effectively at a downstream position by increasing the turbulence of water. The flow disturbing part may be, for example, at least one radial protrusion arranged on the inner wall of the at-least-one-stage diameter-decreased conical passage part or at least one flow disturbing rib extending longitudinally along the inner wall of the at-least-one-stage diameter-decreased conical passage part.

Preferably, providing more stages of diameter-decreased conical passage part helps further increase the pressure and speed of the water flow.

The present disclosure also provides a washing apparatus, which includes any of the micro-bubble treatment agent box assemblies described above, and the micro-bubble treatment agent box assembly is arranged in the washing apparatus to provide the washing apparatus with a micro-bubble water mixture with a treatment agent dissolved.

BRIEF DESCRIPTION OF DRAWINGS

Preferred embodiments of the present disclosure will be described below with reference to the accompanying drawings, in which.

DETAILED DESCRIPTION

Figure 1:
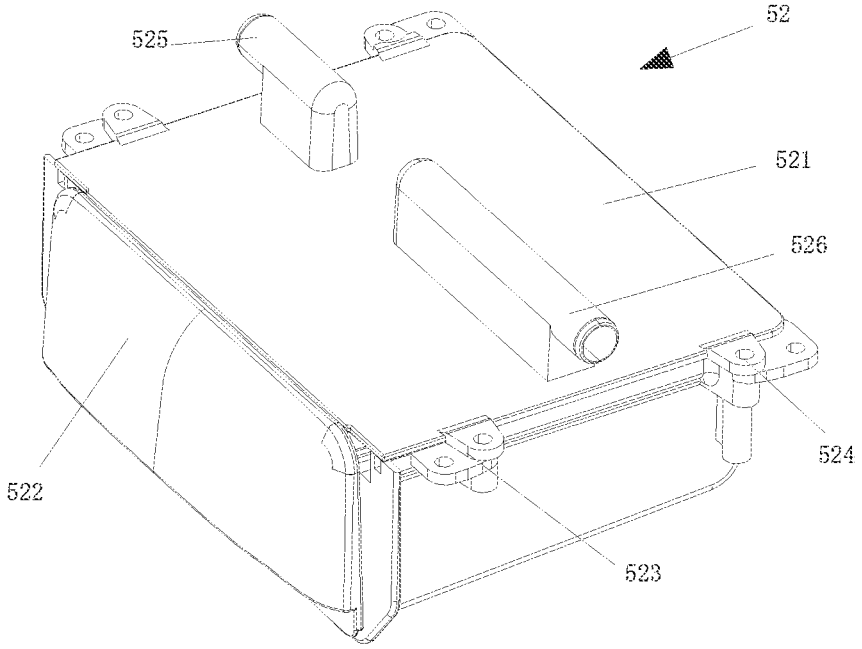
FIG. 1 is a schematic perspective view of an example of a micro-bubble treatment agent box assembly of the present disclosure.

Preferred embodiments of the present disclosure will be described below with reference to the accompanying drawings. It should be understood by those skilled in the art that these embodiments are only used to explain the technical principle of the present disclosure, and are not intended to limit the scope of protection of the present disclosure.

It should be noted that in the description of the present disclosure, terms indicating directional or positional relationships, such as "upper", "lower", "left", "right", "inner", "outer" and the like, are based on the directional or positional relationships shown in the accompanying drawings. They are only used for ease of description, and do not indicate or imply that the device or element must have a specific orientation, or be constructed or operated in a specific orientation, and therefore they should not be considered as limitations to the present disclosure. In addition, terms "first" and "second" are only used for descriptive purposes, and should not be interpreted as indicating or implying relative importance.

In addition, it should also be noted that in the description of the present disclosure, unless otherwise clearly specified and defined, terms "install", "arrange" and "connect" should be understood in a broad sense; for example, the connection may be a fixed connection, or may also be a detachable connection, or an integral connection; it may be a direct connection, or an indirect connection implemented through an intermediate medium, or it may be internal communication between two elements. For those skilled in the art, the specific meaning of the above terms in the present disclosure can be interpreted according to specific situations.

First Embodiment

In order to solve the technical problem that that a generation rate of micro-bubbles in the existing water injection box is not high, the present disclosure provides a micro-bubble treatment agent box assembly 52. In the first embodiment, the micro-bubble treatment agent box assembly includes a housing 521 and a treatment agent box 522 accommodated in the housing 521. At least one water inflow pipe part is provided on the housing 521. At least one of the at least one water inflow pipe part is provided therein with an at-least-one-stage diameter-decreased conical part and a micro-bubble bubbler. A pipe wall of at least one of the at least one water inflow pipe part is also provided with an air inflow hole, and the air inflow hole is positioned between the at-least-one-stage diameter-decreased conical part and the micro-bubble bubbler and communicates with an air inflow pipe arranged on the housing 521. A spray hole is provided on a top end of a most-downstream-stage diameter-decreased conical part, and the spray hole is arranged such that a water flow passing through the at-least-one-stage diameter-decreased conical part can be expanded and sprayed through the spray hole and generate a negative pressure near the air inflow hole, so that air can be sucked into the water inflow pipe part from the air inflow pipe and mix with the water flow to produce bubble water. The bubble water flows through the micro-bubble bubbler to become micro-bubble water, which is then sprayed into the treatment agent box 522. Therefore, as compared with the water injection box with a micro-bubble generator in the prior art, the ability of generating micro-bubbles of the micro-bubble treatment agent box assembly of the present disclosure is greatly improved, thereby improving a dissolution speed, a dissolution rate and a mixing degree of the treatment agent in the water, which can save the amount of treatment agent used.

In one or more examples, the at-least-one-stage diameter-decreased conical part and the micro-bubble bubbler are provided in one or more water inflow pipe parts. Alternatively, the at-least-one-stage diameter-decreased conical part and the micro-bubble bubbler are provided in each of the water inflow pipe parts.

The "diameter-decreased conical part" as used herein refers to a structure in which a diameter of passage formed inside this part is gradually decreased so that the passage has a conical shape.

Figure 2:
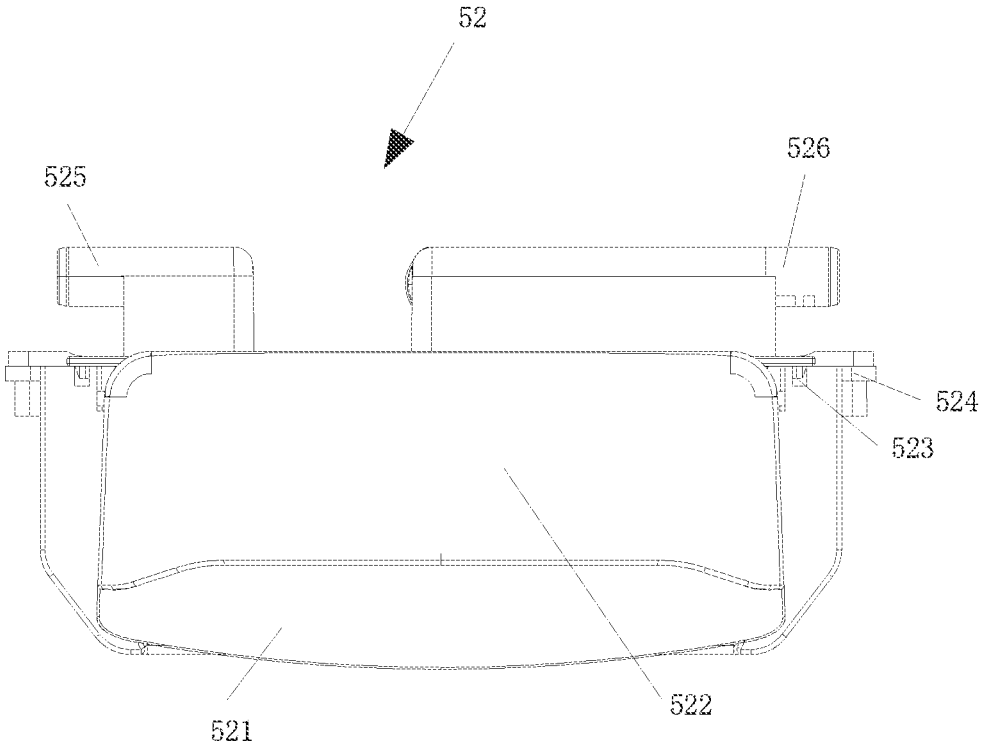
FIG. 2 is a front view of the example of the micro-bubble treatment agent box assembly of the present disclosure shown in FIG. 1.
Figure 3:
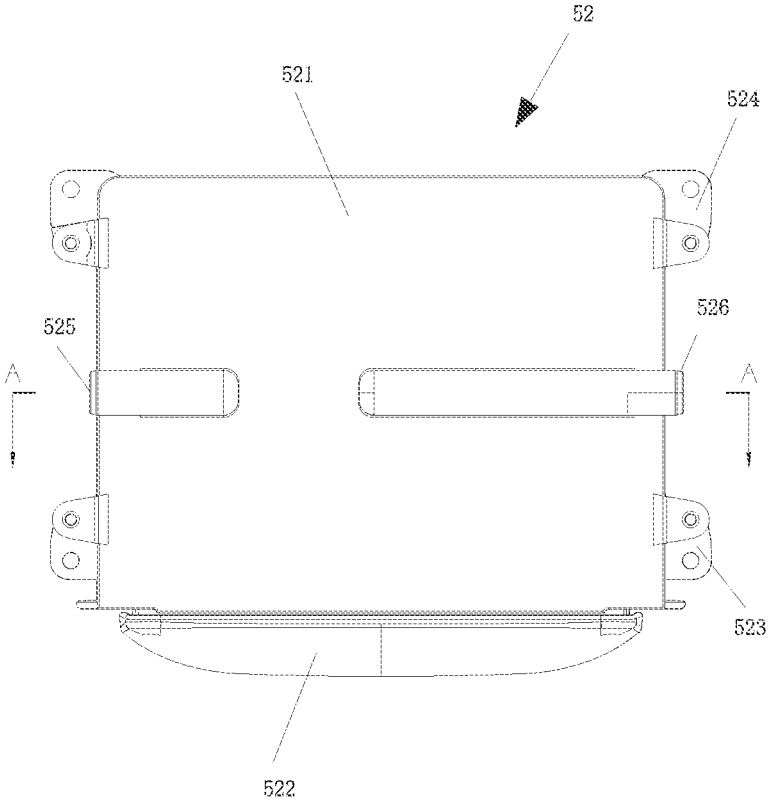
FIG. 3 is a top view of the example of the micro-bubble treatment agent box assembly of the present disclosure shown in FIG. 1.

FIG. 1 is a schematic perspective view of an example of the micro-bubble treatment agent box assembly of the present disclosure, FIG. 2 is a front view of the example of the micro-bubble treatment agent box assembly of the present disclosure shown in FIG. 1, and FIG. 3 is a top view of the example of the micro-bubble treatment agent box assembly of the present disclosure shown in FIG. 1.

Referring to FIGS. 1 to 3, in one or more examples, the micro-bubble treatment agent box assembly 52 includes a housing 521 and a treatment agent box 522. The treatment agent box 522 can be accommodated inside the housing 521, and is movable inside the housing 521 so as to be pushed and pulled into and out of the housing 521. Herein, the treatment agent includes a detergent, one or more clothing care agents, and the like, and the clothing care agents may be, for example, a softener, a sterilizing liquid, and the like.

As shown in FIGS. 1 to 3, the housing 521 is provided with a main water inflow pipe part 525 and an auxiliary water inflow pipe part 526. In one or more examples, the main water inflow pipe part 525 and the auxiliary water inflow pipe part 526 are both arranged on a top of the housing 521 and are distributed on both sides of the top. Both the main water inflow pipe part 525 and the auxiliary water inflow pipe part 526 may be connected to an external water source. With respect to the push/pull direction of the treatment agent box 522, two symmetrical first connection parts 523 and two symmetrical second connection parts 524 are provided on left and right sides of the housing 521 respectively. The first connection parts 523 and the second connection parts 524 are used for fixing the micro-bubble treatment agent box assembly 52 to, for example, a washing apparatus, such as by screwing or welding. In an alternative example, according to requirements, only one water inflow pipe part may be provided on the housing 521, or more than two water inflow pipe parts may also be provided.

Figure 4:
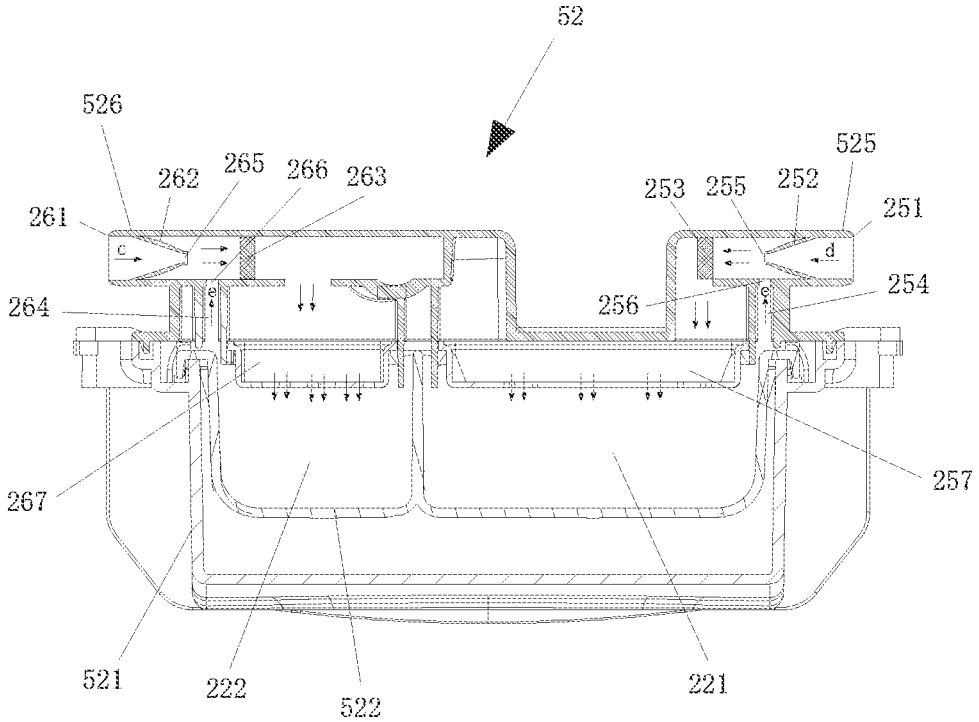
FIG. 4 is a cross-sectional view of an example of the micro-bubble treatment agent box assembly of the present disclosure in a first embodiment, taken along section line A-A of FIG. 3.

FIG. 4 is a cross-sectional view of an example of the micro-bubble treatment agent box assembly 52 of the present disclosure in the first embodiment, taken along section line A-A of FIG. 3. As shown in FIG. 4, in one or more examples, the treatment agent box 522 has a detergent chamber 221 and a care agent chamber 222 arranged side by side. The detergent chamber 221 is arranged to accommodate the detergent, and the care agent chamber 222 is arranged to accommodate the softener. In an alternative example, only one chamber such as for accommodating the detergent may be provided in the treatment agent box 522. In an alternative example, multiple chambers such as two or more care agent chambers may be provided in the treatment agent box 522, each for accommodating a different care agent.

Referring to FIG. 4, the main water inflow pipe part 525 has an inlet end 251 for connecting to the external water source to allow water to flow into the main water inflow pipe part 525 in a flow direction d when needed. In one or more examples, the main water inflow pipe part 525 is provided therein with a one-stage diameter-decreased conical part 252 and a micro-bubble bubbler 253. The water flow is accelerated as it flows through the one-stage diameter-decreased conical part 252 due to a gradually narrowed flow passage cross section. A spray hole 255 is provided at a top of the one-stage diameter-decreased conical part 252, and the spray hole 255 communicates a passage in the one-stage diameter-decreased conical part 252 with a downstream passage in the main water inflow pipe part 525. The water flow accelerated by the one-stage diameter-decreased conical part 252 is expanded and sprayed from the spray hole 255 and thus causes a negative pressure in the downstream passage in the main water inflow pipe part 525. An air inflow hole 256 is also provided on a pipe wall of the main water inflow pipe part 525. The air inflow hole 256 is positioned between the one-stage diameter-decreased conical part 252 and the micro-bubble bubbler 253 located downstream of the spray hole 255 so that the air inflow hole 256 is in the negative pressure area caused by the spray hole 255. The air inflow hole 256 communicates with a first air inflow pipe 254. Therefore, under the action of negative pressure, a large amount of outside air is sucked into the main water inflow pipe part 525 from the first air inflow pipe 254 through the air inflow hole 256 in a direction e and mixes with the water flow in the main water inflow pipe part 525 to generate bubble water containing a large number of bubbles. The bubble water flows further downstream and passes through the micro-bubble bubbler 253. When passing through the micro-bubble bubbler 253, the bubble water is further mixed and cut, thereby producing micro-bubble water containing a large number of micro-bubbles. The micro-bubble water then flows toward a first spray cavity 257 located below the main water inflow pipe part 525 and above the detergent chamber 221, and is uniformly sprayed into the detergent chamber 221 through the first spray cavity 257, thereby helping quickly dissolve the detergent in the detergent chamber 221.

In an alternative example, more than one stage of diameter-decreased conical parts, such as two or more stages of diameter-decreased conical parts, may be provided in the main water inflow pipe part 525, so as to further accelerate the water flow. In this case, the spray hole is arranged at the top of the diameter-decreased conical part of the most downstream stage in the water flow direction.

In one or more examples, a flow disturbing part (not shown in the figure) can be formed on the inner wall of the one-stage diameter-decreased conical part 252. In one or more examples, the flow disturbing part may be at least one flow disturbing rib, such as a plurality of flow disturbing ribs, extending longitudinally along the inner wall of the diameter-decreased conical part of this stage. In an alternative embodiment, the flow disturbing part may be at least one radial protrusion, such as one or more cylindrical protrusions, provided on the inner wall of the diameter-decreased conical part of this stage. In an alternative example, the flow disturbing part may be formed on the inner wall of the diameter-decreased conical part of the most downstream stage, or formed on the inner wall of the diameter-decreased conical part of each stage.

In one or more examples, an outer wall of the one-stage diameter-decreased conical part 252 is separate from the inner wall of the main water inflow pipe part 525, so that an annular gap (not marked in the figure) is formed between the outer wall of the one-stage diameter-decreased conical part 252 and the inner wall of the main water inflow pipe part 525. This annular gap is helpful for the mixing of air and water flow, which further generates more micro-bubbles.

In one or more examples, the micro-bubble bubbler 253 is a hole mesh structure, and the hole mesh structure is fixed inside the main water inflow pipe part 525 and extends along an inner transverse section of the main water inflow pipe part 525, so that the bubble water coming upstream needs to pass through the hole mesh structure before flowing to the downstream first spray cavity 257. The hole mesh structure has at least one fine hole having a diameter reaching a micron scale. Preferably, the diameter of the fine hole is between 0 and 1000 microns; more preferably, the diameter of the fine hole is between 5 and 500 microns. The hole mesh structure can be a plastic fence, a metal mesh, a macromolecular material mesh, or other suitable hole mesh structures. The plastic fence usually refers to a macromolecular fence, which is integrally injection-molded by using a macromolecular material; or a macromolecular material is first made into a plate, and then a microporous structure is formed on the plate by machining to form the plastic fence. The macromolecular material mesh usually refers to a mesh with a microporous structure made by first making a macromolecular material into wires, and then weaving the wires. The macromolecular material mesh may include nylon mesh, cotton mesh, polyester fiber mesh, polypropylene fiber mesh, and the like. Alternatively, the hole mesh structure may be other hole mesh structures capable of generating micro-bubbles, such as a hole mesh structure composed of two non-micron-scale honeycomb structures. When the bubble water flows through the hole mesh structure, the hole mesh structure mixes and cuts the bubble water, thereby generating micro-bubble water.

With continued reference to FIG. 4, the auxiliary water inflow pipe part 526 has an inlet end 261 for connecting to the external water source to allow water to flow into the auxiliary water inflow pipe part 526 in a flow direction c when needed. In one or more examples, the auxiliary water inflow pipe part 526 is provided therein with a one-stage diameter-decreased conical part 262 and a micro-bubble bubbler 263. The water flow is accelerated as it flows through the one-stage diameter-decreased conical part 262 due to a gradually narrowed flow passage cross section. A spray hole 265 is provided at a top of the one-stage diameter-decreased conical part 262, and the spray hole 265 communicates a passage in the one-stage diameter-decreased conical part 262 with a downstream passage in the auxiliary water inflow pipe part 526. The water flow accelerated by the one-stage diameter-decreased conical part 262 is expanded and sprayed from the spray hole 265 and thus causes a negative pressure in the downstream passage in the auxiliary water inflow pipe part 526. An air inflow hole 266 is also provided on a pipe wall of the auxiliary water inflow pipe part 526. The air inflow hole 266 is positioned between the one-stage diameter-decreased conical part 262 and the micro-bubble bubbler 263 located downstream of the spray hole 265 so that the air inflow hole 266 is in the negative pressure area caused by the spray hole 265. The air inflow hole 266 communicates with a second air inflow pipe 264. Therefore, under the action of negative pressure, a large amount of outside air is sucked into the auxiliary water inflow pipe part 526 from the second air inflow pipe 264 through the air inflow hole 266 in a direction e and mixes with the water flow in the auxiliary water inflow pipe part 526 to generate bubble water containing a large number of bubbles. The bubble water flows further downstream and passes through the micro-bubble bubbler 263. When passing through the micro-bubble bubbler 263, the bubble water is further mixed and cut, thereby producing micro-bubble water containing a large number of micro-bubbles. The micro-bubble water then flows toward a second spray cavity 267 located below the auxiliary water inflow pipe part 526 and above the care agent chamber 222, and is uniformly sprayed into the care agent chamber 222 through the second spray cavity 267, thereby helping quickly dissolve the care agent in the care agent chamber 222.

In an alternative example, more than one stage of diameter-decreased conical parts, such as two or more stages of diameter-decreased conical parts, may be provided in the auxiliary water inflow pipe part 526, so as to further accelerate the water flow. In this case, the spray hole is arranged at the top of the diameter-decreased conical part of the most downstream stage in the water flow direction.

In one or more examples, a flow disturbing part (not shown in the figure) can be formed on the inner wall of the one-stage diameter-decreased conical part 262. In one or more examples, the flow disturbing part may be at least one flow disturbing rib, such as a plurality of flow disturbing ribs, extending longitudinally along the inner wall of the diameter-decreased conical part of this stage. In an alternative embodiment, the flow disturbing part may be at least one radial protrusion, such as one or more cylindrical protrusions, provided on the inner wall of the diameter-decreased conical part of this stage. In an alternative example, the flow disturbing part may be formed on the inner wall of the diameter-decreased conical part of the most downstream stage, or formed on the inner wall of the diameter-decreased conical part of each stage.

In one or more examples, an outer wall of the one-stage diameter-decreased conical part 262 is separate from the inner wall of the auxiliary water inflow pipe part 526, so that an annular gap (not marked in the figure) is formed between the outer wall of the one-stage diameter-decreased conical part 262 and the inner wall of the auxiliary water inflow pipe part 526. This annular gap is helpful for the mixing of air and water flow, which further generates more micro-bubbles.

In one or more examples, the configuration of the micro-bubble bubbler 263 in the auxiliary water inflow pipe part 526 may be the same as that of the micro-bubble bubbler 253 in the main water inflow pipe part 525; for example, they are both a hole mesh structure, and the hole mesh structure has at least one fine hole having a diameter reaching a micron scale.

In one or more examples, the first air inflow pipe 254 and the second air inflow pipe 264 are each integrally combined with the housing 521. Alternatively, the first air inflow pipe 254 and/or the second air inflow pipe 264 may be configured independently from the housing 521.

Second Embodiment

In order to solve the technical problem that a generation rate of micro-bubbles in the existing water injection box is not high, the present disclosure provides a micro-bubble treatment agent box assembly 52. The micro-bubble treatment agent box assembly includes a housing 521 and a treatment agent box 522 accommodated in the housing 521. The housing 521 is provided with at least one water inflow pipe part, and at least one spray cavity positioned above the treatment agent box 522. An at-least-one-stage diameter-decreased conical passage part is provided between at least one of the at least one water inflow pipe part and at least one of the at least one spray cavity in a water flow direction C. A spray hole is provided at a downstream end of the at-least-one-stage diameter-decreased conical passage part. An air inflow passage is also provided on the housing 521, and an outlet of the air inflow passage is positioned close to the spray hole, so that water flow is expanded and sprayed from the spray hole to generate a negative pressure near the outlet, which sucks in outside air through the air inflow passage so that the outside air mixes with the water flow to form bubble water. At least one of the at least one spray cavity is provided therein with a micro-bubble bubbler, so that the bubble water forms micro-bubble water under the action of the micro-bubble bubbler, which is then sprayed into the treatment agent box 522. Therefore, as compared with the water injection box with a micro-bubble generator in the prior art, the ability of generating micro-bubbles of the micro-bubble treatment agent box assembly of the present disclosure is greatly improved, thereby improving a dissolution speed, a dissolution rate and a mixing degree of the treatment agent in the water, which can save the amount of treatment agent used.

In one or more examples, the at-least-one-stage diameter-decreased conical passage part is provided between each water inflow pipe part and a spray cavity corresponding to this water inflow pipe part, and a micro-bubble bubbler is arranged in this spray cavity. Alternatively, in the case of a plurality of water inflow pipe parts, according to requirements, the at-least-one-stage diameter-decreased conical passage part is provided between some of the plurality of water inflow pipe parts and the corresponding spray cavities.

The "diameter-decreased conical passage part" as used herein refers to a structure in which a diameter of passage formed inside this part is gradually decreased so that the passage has a conical shape.

FIG. 1 is a schematic perspective view of an example of the micro-bubble treatment agent box assembly of the present disclosure, FIG. 2 is a front view of the example of the micro-bubble treatment agent box assembly of the present disclosure shown in FIG. 1, and FIG. 3 is a top view of the example of the micro-bubble treatment agent box assembly of the present disclosure shown in FIG. 1.

Referring to FIGS. 1 to 3, in one or more examples, the micro-bubble treatment agent box assembly 52 includes a housing 521 and a treatment agent box 522. The treatment agent box 522 can be accommodated inside the housing 521, and is movable inside the housing 521 so as to be pushed and pulled into and out of the housing 521. Herein, the treatment agent includes a detergent, one or more clothing care agents, and the like, and the clothing care agents may be, for example, a softener, a sterilizing liquid, and the like.

As shown in FIGS. 1 to 3, in one or more examples, the housing 521 is provided with a main water inflow pipe part 525 and an auxiliary water inflow pipe part 526. The main water inflow pipe part 525 and the auxiliary water inflow pipe part 526 are both arranged on a top of the housing 521 and are distributed on both sides of the top. Both the main water inflow pipe part 525 and the auxiliary water inflow pipe part 526 may be connected to an external water source. With respect to the push/pull direction of the treatment agent box 522, two symmetrical first fixing parts 523 and two symmetrical second fixing parts 524 are provided on left and right sides of the housing 521 respectively. The first fixing parts 523 and the second fixing parts 524 are used for fixing the micro-bubble treatment agent box assembly 52 to, for example, a washing apparatus, such as by screwing or welding. In an alternative example, according to requirements, only one water inflow pipe part may be provided on the housing 521, or more than two water inflow pipe parts may also be provided.

Figure 5:
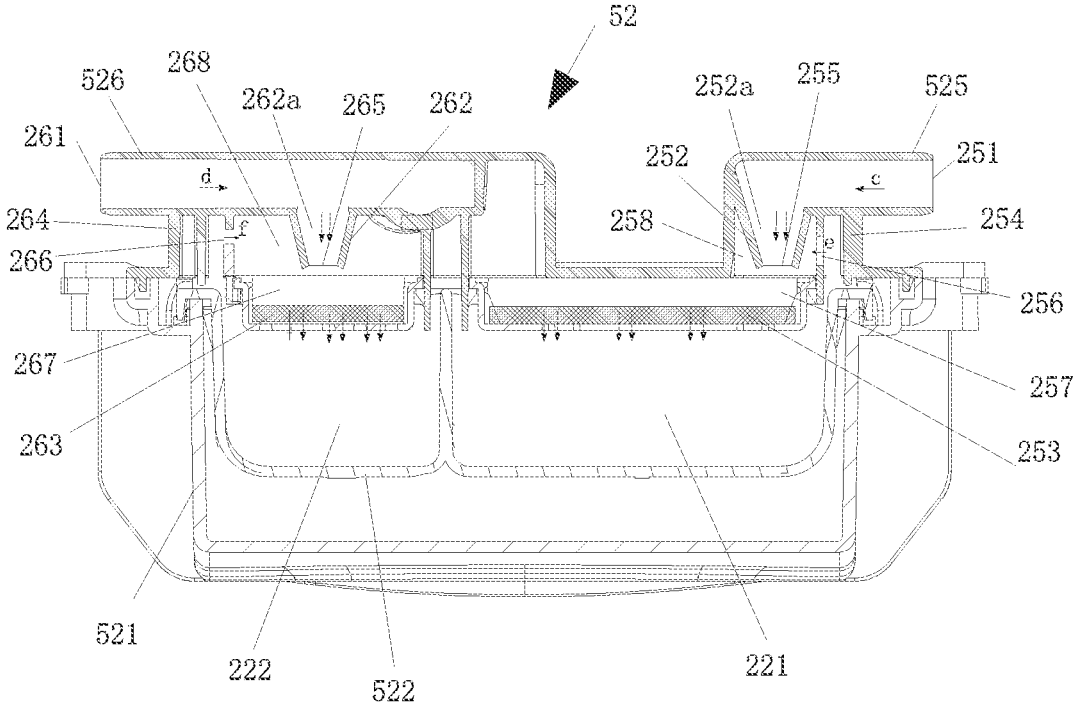
FIG. 5 is a cross-sectional view of an example of the micro-bubble treatment agent box assembly of the present disclosure in a second embodiment, taken along section line A-A of FIG. 3.

FIG. 5 is a cross-sectional view of an example of the micro-bubble treatment agent box assembly 52 of the present disclosure in the second embodiment, taken along section line A-A of FIG. 3. As shown in FIG. 5, in one or more examples, the treatment agent box 522 has a detergent chamber 221 and a care agent chamber 222 arranged side by side. The detergent chamber 221 is arranged to accommodate the detergent, and the care agent chamber 222 is arranged to accommodate the softener. In an alternative example, only one chamber such as for accommodating the detergent may be provided in the treatment agent box 522. In an alternative example, multiple chambers may be provided in the treatment agent box 522; for example, these chambers include two or more care agent chambers, each for accommodating a different care agent.

Referring to FIG. 5, the main water inflow pipe part 525 has an inlet end 251 for connecting to the external water source to allow water to flow into the main water inflow pipe part 525 in a flow direction c when needed. In one or more examples, the main water inflow pipe part 525 is located above the first spray cavity 257, and the first spray cavity 257 is located above the detergent chamber 221. A first connection part 254 is formed between the main water inflow pipe part 525 and the first spray cavity 257. The first connection part 254 encloses a closed first space 258 between the main water inflow pipe part 525 and the first spray cavity 257. In the closed first space 258, a first one-stage diameter-decreased conical passage part 252 is provided, which is located above the first spray cavity 257. In one or more examples, the first one-stage diameter-decreased conical passage part 252 is integrally formed with the main water inflow pipe part 525 and extends downwardly within the first space 258 from a water outflow end of the main water inflow pipe part 525. Alternatively, the first one-stage diameter-decreased conical passage part 252 may also be formed independently from the main water inflow pipe part 525. The first one-stage diameter-decreased conical passage part 252 has a first diameter-decreased conical passage 252*a* formed therein in the water flow direction, and is formed with a first spray hole 255 at a downstream end. The water flow flows into the first diameter-decreased conical passage 252*a* from the main water inflow pipe part 525 and is pressurized therein. The pressurized water flow is sprayed from the first spray hole 255 and is rapidly expanded. Therefore, a negative pressure is caused near a downstream position of the first spray hole 255. A first air inflow passage 256 is also formed on the first connection part 254. An outlet of the first air inflow passage 256 is close to the first spray hole 255. Therefore, under the action of negative pressure, the outside air is sucked into the first space 258 in a flow direction e and mixes with the water flow sprayed from the first spray hole 255. The bubble water then enters the first spray cavity 257. A first micro-bubble bubbler 253 is provided at a bottom of the first spray cavity 257. The first micro-bubble bubbler 253 covers sprinkle holes (not shown in the figure) formed at the bottom of the first spray cavity 257. Therefore, the bubble water needs to first pass through the first micro-bubble bubbler 253 in the first spray cavity 257 and thus becomes micro-bubble water, which is then uniformly sprayed into the detergent chamber 221 through the sprinkle holes, thereby helping quickly dissolve the detergent in the detergent chamber 221.

In an alternative example, the first one-stage diameter-decreased conical passage part 252 may be replaced by more than one stage of diameter-decreased conical passage parts, such as two or more stages of diameter-decreased conical passage parts, so as to further pressurize (accelerate) the water flow. In this case, the spray hole is arranged at the top of the diameter-decreased conical passage part of the most downstream stage in the water flow direction.

In one or more examples, a flow disturbing part (not shown in the figure) can be formed on the inner wall of the first one-stage diameter-decreased conical passage part 252. In one or more examples, the flow disturbing part may be at least one flow disturbing rib, such as a plurality of flow disturbing ribs, extending longitudinally along the inner wall of the diameter-decreased conical passage part of this stage. In an alternative embodiment, the flow disturbing part may be at least one radial protrusion, such as one or more cylindrical protrusions, provided on the inner wall of the diameter-decreased conical passage part of this stage. In an alternative example, the flow disturbing part may be formed on the inner wall of the diameter-decreased conical passage part of the most downstream stage, or formed on the inner wall of the diameter-decreased conical passage part of each stage.

In one or more examples, the first micro-bubble bubbler 253 is a hole mesh structure. The hole mesh structure has at least one fine hole having a diameter reaching a micron scale. Preferably, the diameter of the fine hole is between 0 and 1000 microns; more preferably, the diameter of the fine hole is between 5 and 500 microns. The hole mesh structure can be a plastic fence, a metal mesh, a macromolecular material mesh, or other suitable hole mesh structures. The plastic fence usually refers to a macromolecular fence, which is integrally injection-molded by using a macromolecular material; or a macromolecular material is first made into a plate, and then a microporous structure is formed on the plate by machining to form the plastic fence. The macromolecular material mesh usually refers to a mesh with a microporous structure made by first making a macromolecular material into wires, and then weaving the wires. The macromolecular material mesh may include nylon mesh, cotton mesh, polyester fiber mesh, polypropylene fiber mesh, and the like. Alternatively, the hole mesh structure may be other hole mesh structures capable of generating micro-bubbles, such as a hole mesh structure composed of two non-micron-scale honeycomb structures. When the bubble water flows through the hole mesh structure, the hole mesh structure mixes and cuts the bubble water, thereby generating micro-bubble water.

With continued reference to FIG. 5, the auxiliary water inflow pipe part 526 has an inlet end 261 for connecting to the external water source to allow water to flow into the auxiliary water inflow pipe part 526 in a flow direction d when needed. In one or more examples, the auxiliary water inflow pipe part 526 is located above the second spray cavity 267, and a second connection part 264 is formed between the auxiliary water inflow pipe part 526 and the second spray cavity 267. The second connection part 264 encloses a closed second space 268 between the auxiliary water inflow pipe part 526 and the second spray cavity 267. In the closed second space 268, a second one-stage diameter-decreased conical passage part 262 is provided, which is located above the second spray cavity 267. In one or more examples, the second one-stage diameter-decreased conical passage part 262 is integrally formed with the auxiliary water inflow pipe part 526 and extends perpendicularly and downwardly within the second space 268 from a lower pipe wall of the auxiliary water inflow pipe part 526. Alternatively, the second one-stage diameter-decreased conical passage part 262 may also be formed independently from the auxiliary water inflow pipe part 526. The second one-stage diameter-decreased conical passage part 262 has a second diameter-decreased conical passage 262*a* formed therein in the water flow direction, and is formed with a second spray hole 265 at a downstream end. The water flow flows into the second diameter-decreased conical passage 262*a* from the auxiliary water inflow pipe part 526 and is pressurized therein. The pressurized water flow is sprayed from the second spray hole 265 and is rapidly expanded. Therefore, a negative pressure is caused near a downstream position of the second spray hole 265. A second air inflow passage 266 is also formed on the second connection part 264. An outlet of the second air inflow passage 266 is close to the second spray hole 265. Therefore, under the action of negative pressure, the outside air is sucked into the second space 268 in a flow direction f and mixes with the water flow sprayed from the second spray hole 265. The bubble water then enters the second spray cavity 267. A second micro-bubble bubbler 263 is provided at a bottom of the second spray cavity 267. The second micro-bubble bubbler 263 covers sprinkle holes (not shown in the figure) formed at the bottom of the second spray cavity 267. Therefore, the bubble water needs to first pass through the second micro-bubble bubbler 263 in the second spray cavity 267 and thus becomes micro-bubble water, which is then uniformly sprayed into the care agent chamber 222 through the sprinkle holes, thereby helping quickly dissolve the care agent in the care agent chamber 222.

In an alternative example, the second one-stage diameter-decreased conical passage part 262 may be replaced by more than one stage of diameter-decreased conical passage parts, such as two or more stages of diameter-decreased conical passage parts, so as to further pressurize (accelerate) the water flow. In this case, the spray hole is arranged at the top of the diameter-decreased conical passage part of the most downstream stage in the water flow direction.

In one or more examples, a flow disturbing part (not shown in the figure) can be formed on the inner wall of the second one-stage diameter-decreased conical passage part 262. In one or more examples, the flow disturbing part may be at least one flow disturbing rib, such as a plurality of flow disturbing ribs, extending longitudinally along the inner wall of the diameter-decreased conical passage part of this stage. In an alternative embodiment, the flow disturbing part may be at least one radial protrusion, such as one or more cylindrical protrusions, provided on the inner wall of the diameter-decreased conical passage part of this stage. In an alternative example, the flow disturbing part may be formed on the inner wall of the diameter-decreased conical passage part of the most downstream stage, or formed on the inner wall of the diameter-decreased conical passage part of each stage.

In one or more examples, the configuration of the second micro-bubble bubbler 263 may be the same as that the first micro-bubble bubbler 253; for example, they are both a hole mesh structure, and the hole mesh structure has at least one fine hole having a diameter reaching a micron scale.

The present disclosure also provides a washing apparatus, which includes the micro-bubble treatment agent box assembly 52 of the present disclosure. The micro-bubble treatment agent box assembly 52 is arranged in the washing apparatus and configured to provide a mixture of treatment agent and micro-bubble water. The micro-bubble treatment agent box assembly can not only improve the washing ability of the washing apparatus, but also can reduce the amount of detergent used and a residual amount of detergent such as in the clothing, which is not only advantageous for the user's health, but also can improve the user experience.

Figure 6:
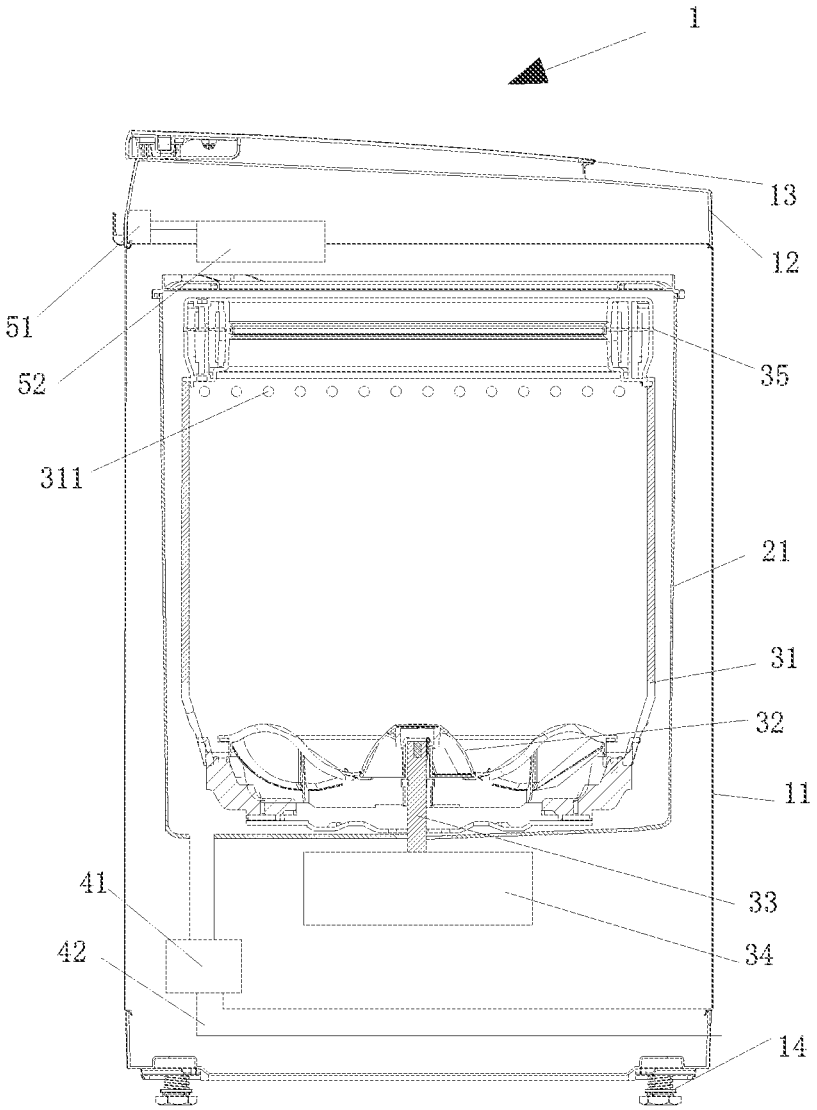
FIG. 6 is a schematic structural view of an example of a washing apparatus including the micro-bubble treatment agent box assembly of the present disclosure.

Reference is made to FIG. 6, which is a schematic structural view of an example of a washing apparatus including a micro-bubble treatment agent box assembly according to the present disclosure. In this example, the washing apparatus is a pulsator washing machine 1. Alternatively, in other examples, the washing apparatus may be a drum washing machine or a washing-drying integrated machine, etc.

As shown in FIG. 6, the pulsator washing machine 1 (hereinafter referred to as the washing machine) includes a cabinet 11. Feet 14 are provided at a bottom of the cabinet 11. An upper part of the cabinet 11 is provided with a tray 12, and the tray 12 is pivotally connected with an upper cover 13. An outer tub 21 serving as a water containing tub is provided inside the cabinet 11. An inner tub 31 is arranged in the outer tub 21, a pulsator 32 is arranged at a bottom of the inner tub 31, and a motor 34 is fixed at a lower part of the outer tub 21. The motor 34 is drivingly connected with the pulsator 32 through a transmission shaft 33. A spin-drying hole 311 is provided on a side wall of the inner tub 31 close to a top end. A drain valve 41 is provided on a drain pipe 42, and an upstream end of the drain pipe 42 communicates with a bottom of the outer tub 21. The washing machine further includes a water inflow valve 51 and a micro-bubble treatment agent box assembly 52 communicating with the water inflow valve 51, and the micro-bubble treatment agent box assembly 52 is installed above a top of the outer tub 21. Water enters the micro-bubble treatment agent box assembly 52 through the water inflow valve 51 to quickly dissolve one or more treatment agents in the treatment agent box by using the micro-bubble water, such as the detergent and/or one or more clothing care agents. The micro-bubble treatment agent box assembly 52 then provides a mixture of treatment agent and micro-bubble water to the outer tub 21 for clothing washing. The micro-bubbles in the water impact the detergent during the breaking up process, and negative charges carried by the micro-bubbles can also adsorb the detergent, so the micro-bubbles can increase a mixing degree of the detergent and the water, thereby reducing the amount of detergent used and a residual amount of detergent in the clothing. In addition, the micro-bubbles in the inner tub 31 will also impact stains on the clothing, and will adsorb foreign matters that generate the stains. Therefore, the micro-bubbles also enhance a stain removal performance of the washing machine.

Figure 7:
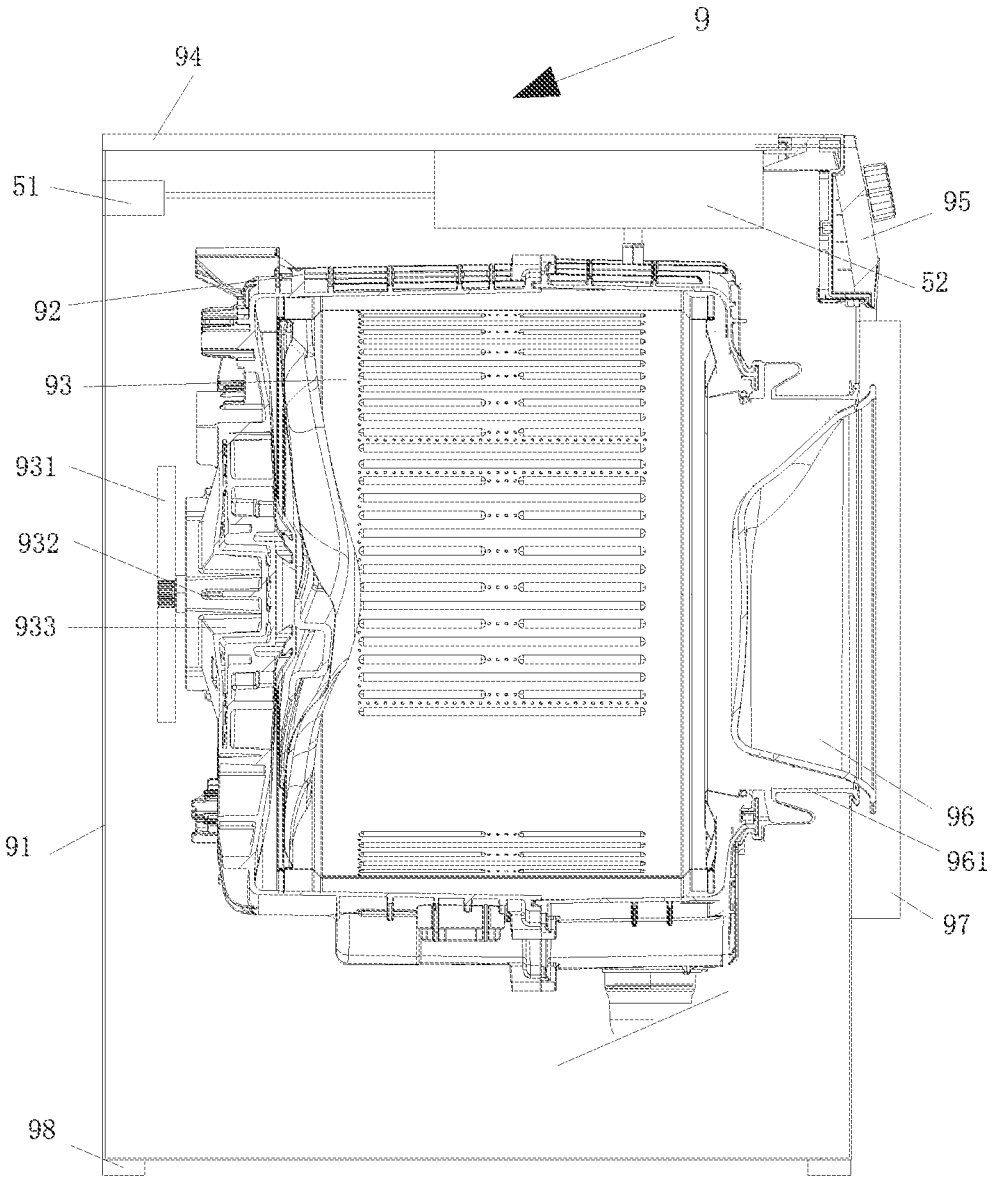
FIG. 7 is a schematic structural view of another example of the washing apparatus including the micro-bubble treatment agent box assembly of the present disclosure.

Reference is made to FIG. 7, which is a schematic structural view of another example of the washing apparatus including the micro-bubble treatment agent box assembly according to the present disclosure. In this example, the washing apparatus is a drum washing machine 9.

As shown in FIG. 7, the drum washing machine 9 includes a shell 91 and feet 98 located at a bottom of the shell. A top panel 94 is provided at a top of the shell 91. A front side of the shell 91 (an operation side facing the user) is provided with a door 97 that allows the user to put clothing and the like into the drum washing machine, and the door 97 is also provided with an observation window 96 for viewing an interior of the washing machine. A sealing window gasket 961 is also provided between the observation window 96 and the shell 91, and the sealing window gasket 961 is fixed on the shell 91. A control panel 95 of the drum washing machine 9 is arranged on an upper part of the front side of the shell 91 to facilitate the user's operation. An outer cylinder 92 and an inner cylinder 93 are arranged inside the shell 91. The inner cylinder 93 is positioned inside the outer cylinder 92. The inner cylinder 93 is connected to a motor 931 (e.g., a direct drive motor) through a transmission shaft 932 and a bearing 933. A water inflow valve 51 is provided on an upper part of a rear side of the shell 91, and the water inflow valve 51 is connected to the micro-bubble treatment agent box assembly 52 through a water pipe. As shown in FIG. 7, the micro-bubble treatment agent box assembly 52 is positioned below the top panel 94 and above the outer cylinder 92. Similar to the above embodiment, water enters the micro-bubble treatment agent box assembly 52 from the water inflow valve 51 through a water pipe to quickly dissolve one or more treatment agents in the treatment agent box by using the micro-bubble water, such as the detergent and/or one or more clothing care agents. The micro-bubble treatment agent box assembly 52 then provides a mixture of treatment agent and micro-bubble water to the outer cylinder 92 for clothing washing.

Hitherto, the technical solutions of the present disclosure have been described in connection with the preferred embodiments shown in the accompanying drawings, but it is easily understood by those skilled in the art that the scope of protection of the present disclosure is obviously not limited to these specific embodiments. Without departing from the principles of the present disclosure, those skilled in the art can combine technical features from different embodiments, and can also make equivalent changes or replacements to relevant technical features. All these technical solutions after such changes or replacements will fall within the scope of protection of the present disclosure.

What is claimed is:

1. A micro-bubble treatment agent box assembly, comprising a housing and a treatment agent box accommodated in the housing, wherein:

at least one water inflow pipe part is provided on the housing, and at least one of the at least one water inflow pipe part is provided therein with an at-least-one-stage diameter-decreased conical part and a micro-bubble bubbler; a pipe wall of the at least one of the at least one water inflow pipe part is also provided with an air inflow hole; and the air inflow hole is positioned between the at-least-one-stage diameter-decreased conical part and the micro-bubble bubbler and communicates with an air inflow pipe provided on the housing; and a spray hole is provided at a top end of a most-downstream-stage diameter-decreased conical part; the spray hole is arranged such that a water flow flowing through the at-least-one-stage diameter-decreased conical part can be expanded and sprayed through the spray hole and generate a negative pressure near the air inflow hole, so that air can be sucked into the water inflow pipe part from the air inflow pipe and mix with the water flow to generate bubble water; and the bubble water flows through the micro-bubble bubbler to become micro-bubble water, which is then sprayed into the treatment agent box.

2. The micro-bubble treatment agent box assembly according to claim 1, wherein a flow disturbing part is provided on an inner wall of the at-least-one-stage diameter-decreased conical part.

3. The micro-bubble treatment agent box assembly according to claim 2, wherein the flow disturbing part is at least one radial protrusion arranged on the inner wall of the at-least-one-stage diameter-decreased conical part or at least one flow disturbing rib extending longitudinally along the inner wall of the at-least-one-stage diameter-decreased conical part.

4. The micro-bubble treatment agent box assembly according to claim 2, wherein the flow disturbing part is positioned on an inner wall of the most-downstream-stage diameter-decreased conical part.

5. The micro-bubble treatment agent box assembly according to claim 1, wherein the at-least-one-stage diameter-decreased conical part comprises two or more stages of diameter-decreased conical parts.

6. The micro-bubble treatment agent box assembly according to claim 1, wherein at least one spray cavity is also provided in the housing, and the at least one spray cavity is arranged between the at least one water inflow pipe part and the treatment agent box so that the micro-bubble water is sprayed into the treatment agent box through the at least one spray cavity.

7. The micro-bubble treatment agent box assembly according to claim 1, wherein the at least one water inflow pipe part comprises a main water inflow pipe part and an auxiliary water inflow pipe part, and the treatment agent box comprises a detergent chamber and at least one care agent chamber; wherein the main water inflow pipe part is configured to provide micro-bubble water for the detergent chamber, and the auxiliary water inflow pipe part is configured to provide micro-bubble water for the at least one care agent chamber.

8. The micro-bubble treatment agent box assembly according to claim 1, wherein the micro-bubble bubbler is a hole mesh structure, and the hole mesh structure has at least one fine hole having a diameter reaching a micron scale.

9. The micro-bubble treatment agent box assembly according to claim 8, wherein the hole mesh structure comprises plastic fence, metal mesh, or macromolecular material mesh.

10. A washing apparatus, comprising the micro-bubble treatment agent box assembly according to claim 1, wherein the micro-bubble treatment agent box assembly is arranged in the washing apparatus to provide the washing apparatus with a micro-bubble water mixture with a treatment agent dissolved.

* * * * *